US005379710A

United States Patent [19]

Parnigoni

[11] Patent Number: 5,379,710

[45] Date of Patent: Jan. 10, 1995

[54] ASYMMETRICAL SAILING CATAMARAN KEELS

[76] Inventor: Johann Parnigoni, 522 Halfmoon Road, Brownsburg, QC, Canada, JOV 1AO

[21] Appl. No.: 136,158

[22] Filed: Oct. 15, 1993

[51] Int. Cl.[6] ..... B63B 1/00

[52] U.S. Cl. ..... 114/61; 114/292

[58] Field of Search ..... 114/61, 123, 283, 292

[56] References Cited

U.S. PATENT DOCUMENTS

| | | | |
|---|---|---|---|
| 2,918,031 | 12/1959 | Gunderson | 114/61 |
| 3,139,058 | 6/1964 | Robinson | 114/61 |
| 3,831,540 | 8/1974 | Case | 114/61 |
| 5,038,696 | 8/1991 | Athanasiou et al. | 114/61 |
| 5,188,049 | 2/1993 | Graf | 114/61 |
| 5,231,949 | 8/1993 | Hadley | 114/61 |

*Primary Examiner*—Stephen P. Avila
*Attorney, Agent, or Firm*—Frank A. Lukasik

[57] ABSTRACT

The present invention consists of two asymmetrical hulls connected by a crossbeam or deck structure to make up a catamaran. Each hull has a rounded or shallow angled outer surface below the water line. The inboard side presents a vertical, or near vertical surface below the water line to act as an effective leeway preventer, to resist sideways movement under normal sailing conditions. The vertical surface may have a winglet at the keel and a flow directing vane to prevent vortexes and to maintain parallel flow of water along the whole length of the surface.

8 Claims, 6 Drawing Sheets

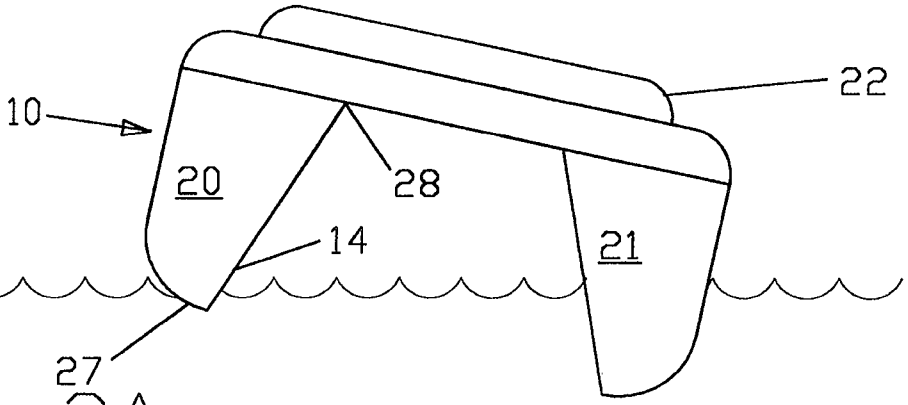
Fig. 2A
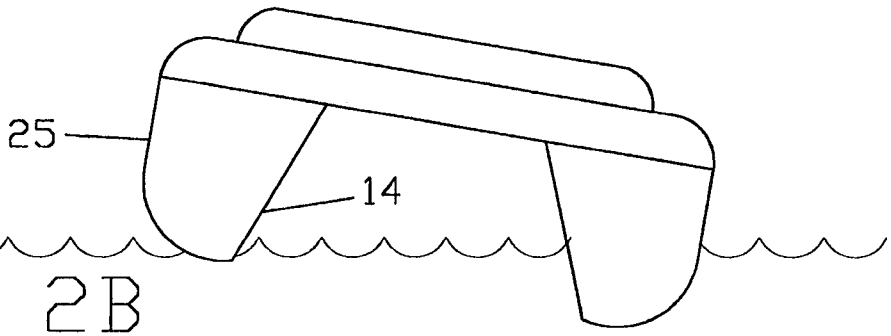
Fig. 2B
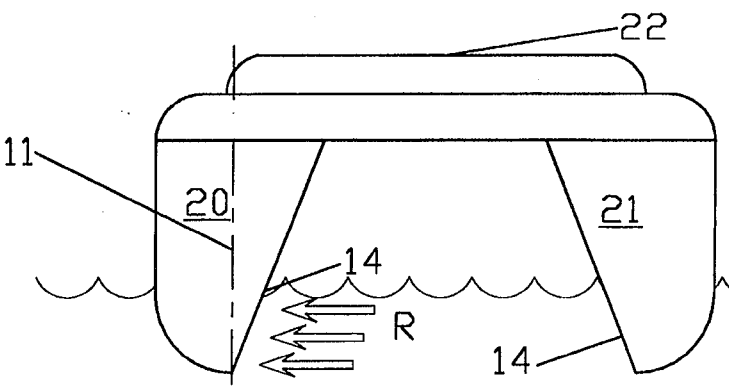
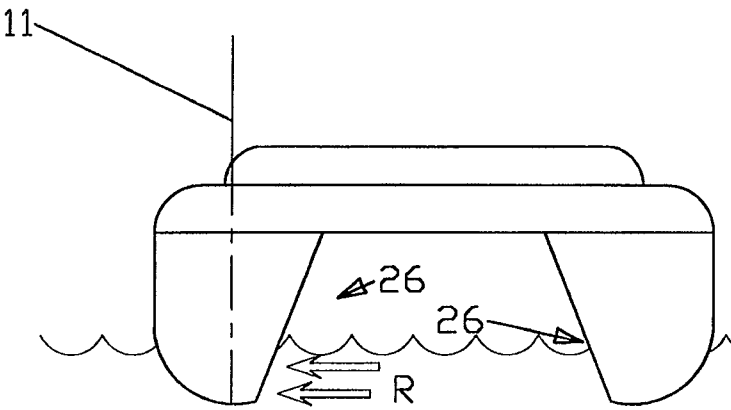

ASYMMETRICAL SAILING CATAMARAN KEELS

BACKGROUND OF THE INVENTION

1. Field of the Invention

This invention relates generally to sailboats and more particularly to the shape of hulls for larger sailing catamarans.

2. Discussion of the Prior Art

One of the most perplexing problems encountered by sailboats is to find the ultimate shape to provide high speed while increasing the stability of the boat.

Several prior art boats have attempted to resolve the problems. First is Canadian Patent No. 307,326 to Mallison (U.S. Pat. No. 1,705,413) which describes a boat with a tunnel hull. Although "catamaran" is mentioned in the patent, it is closer to a monohull boat with twin keels, inasmuch as the complete tunnel is under water and the boat can therefore not be called a catamaran. The two appendages (twin bilges) are claimed to increase stability and there is a reference to "resisting drift" and "rapidity of travel". The boat will travel no faster than a monohull sailing boat in light wind and will be slower than a normal sailing boat with a single keel in higher winds due to the increased wetted area. This boat will not perform like a catamaran, since the bilges are too narrowly spaced to prevent heeling in any appreciable way.

U.S. Pat. No. 3,877,406, describes a boat which only carries the mast and the sail used to pull a person through the water. The "keel" of this boat is the body of the person which is submerged between the floats. The vertical insides of the floats are to prevent a bow wave, which would presumably be very small in any case, judging by the low weight of the assembly and the very low speed attainable while dragging a person through the water.

Canadian Patent Application Serial No. 2,043,801 describes a trimaran of unconventional configuration, tricycle style where the central pontoon (hull) is performing the steering function (no rudders in back) and is far ahead of the lateral pontoons. The sharply hooked lateral pontoons are described to function whereby leeway preventing function is relegated to the windward pontoon and the leeward pontoon presents a shallow angle to sideways movement. This "riding up" is supposed to prevent heeling. First, the pontoons as depicted do not have enough buoyancy to support the structure above water, and secondly, if leeway is efficiently prevented by the windward pontoon then there will be no generated lift from any sideways movement. If leeway is not prevented, then the whole concept will not work.

SUMMARY OF THE INVENTION

The present invention is a design for the shape of catamaran hulls for larger sailing catamarans. The type of boats which can benefit from the present invention are the kind of boats which are normally meant to be sailed with both hulls in the water, generally larger boats which do not rely on the weight of the crew to keep the boat balanced. The present invention describes a certain configuration of the submerged portion of the hull, which will allow the boat to slip sideways when it is in danger of being overpowered by the heeling force generated by the sail as a result of an unexpected gust of wind or be in danger of capsizing due to a combination of wind power and associated steep waves.

BRIEF DESCRIPTION OF THE DRAWINGS

FIGS. 2*a–d* depict several embodiments of the instant invention.

DESCRIPTION OF THE PREFERRED EMBODIMENT

The primary objective of the present invention is to provide a hull shape which combines the advantages of the V-hulls and the hulls with fixed keels, with the advantages of retractable dagger boards, without suffering the disadvantages of either.

The first objective is to create a hull shape which allows the boat to slip sideways, when it gets to a point of being overpowered, and thus reducing some of the pressure on the sails, without any intervention by the crew.

The second objective is to automatically initiate a downwind heading, thereby converting a large portion of the heeling force into a propulsive force. This corrective action should take place without any action of the helmsman.

The above features will add a significant degree of safety over current catamaran designs. It will not make the catamaran completely capsize-proof; since a catamaran, like a monohull, can also be pitch-poled or rolled by extremely large waves. The hull shape of the present invention will result in a catamaran with a draft comparable to a modified V-hull, and less than any other current design, since there are no thin appendages at the bottom of the hulls. Buoyancy is carried down to the keel.

The present invention consists of two asymmetrical hulls 20 and 21, connected by a suitable crossbeam or deck structure 22 to make up a catamaran 10. Each hull must present a rounded or shallow angled surface, on the outboard side 23 of the catamaran, below the water line. This will allow the boat to slip sideways once the windward hull has lifted completely, or nearly so, out of the water.

Figure 2C:
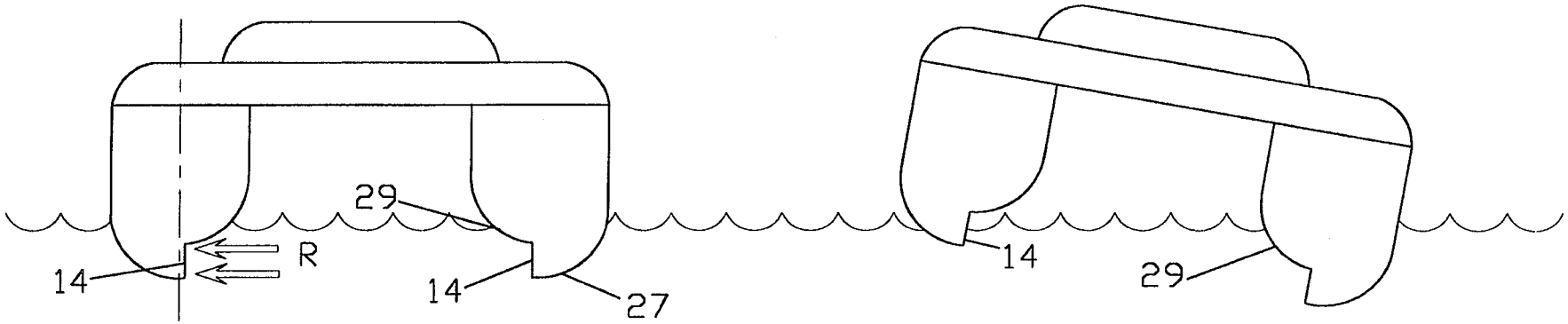

The inboard side 24 of each hull must be shaped to present a vertical, or near vertical surface 14, below the water line act as an effective leeway preventer, to resist sideways movement, under normal sailing conditions. The shape of topsides 25, the portion of the hulls which are mainly above water, is of little importance for the purpose of achieving the claimed benefits. The inboard side 26 of each hull could be a flat surface 14 from the keel 27 to the top rail 28, (FIG. 2, *a* and *b*) or a widening of the hull as at 29, to provide interior space, could begin well below the waterline (FIG. 2*c* and *d*).

The present invention may be embodied in designs using chined hulls or full contoured hulls with equal efficiency as shown in FIGS. 2, *c* and *d*.

For purposes of the present invention it is important to understand the definition of terms used to explain the invention as well as the prior art:

CATAMARAN: A sail powered, twin hulled boat whose stability does not depend on ballast or crew being shifted from side to side when changing tacks.

MONOHULL: A sail-powered, single-hulled boat whose stability depends mainly on ballast affixed to the lower portion of the boat or in the keel, generally making up the keel.

KEEL:

(a) The lowest part of a boat's hull;

(b) A flat or airfoil shaped appendage at the bottom of a boat's hull for the purpose of preventing leeway.

DAGGER BOARD: A flat or airfoil shaped board which can be raised or lowered through the bottom of a boat's hull for the purpose of providing a leeway preventing surface.

CG: Center of Gravity. The point through which the force of gravity produced by a vessel's mass can be considered to act CB: Center of Buoyancy. The point through which the force of buoyancy produced by a vessel's displacement can be considered to act; the center of gravity of the displaced water.

CE: Center of Effort. The point through which the force developed by the sail, or the sails, can be considered to act.

CLR: Center of Lateral Resistance. The point through which the combined forces which resist sideways movement can be considered to act.

To understand the rationale underlying the present invention, it should be understood that it is important to look at sailboat stability; how it is achieved in traditional boats (monohulls) and how an unballasted catamaran achieves stability.

A monohull derives its stability mainly from a large amount of ballast (sometimes 50% of its; total weight) in the form of a keel, attached to the lower portion of the hull. This keel serves two purposes:

a. It keeps the boat upright. Since it consists of a large mass, attached below the center of buoyancy it pulls the bottom of the boat down and thus counteracts the weight of the mast and rigging and the heeling force generated by the wind on the sail, and the effect of waves on the hull, which would otherwise topple the boat.

b. It acts as a leeway preventer, that is, it resists the forces trying to push the boat sideways. It is shaped like a large plate, often streamlined, shaped like an airfoil. Without a leeway preventer, the boat could not be steered, it would be blown like a leaf on the surface of the water. A foil-shaped keel will actually generate lift in the windward direction, counteracting to some degree the leeward component of the forces produced by the sail.

The initial stability of a monohull boat is relatively low, meaning that a heel angle of 2 or 3 degrees can be achieved with very little force. Stability increases progressively at higher and higher heel angles, to about an angle of 100 degrees. Analysis of the forces affecting a monohull sailing boat, when under sail, shows the following interaction of events:

a. As the wind passes over the sail, power is generated, acting at a right angle to the cord of the sail. A portion of this power is used to push the boat forward, while the remainder is trying to push the boat sideways. The proportions of the power-split depends on the angle of the sail in relation to the longitudinal axis of the boat. On a broad reach (when the apparent wind comes over the port or starboard aft quarter) nearly all of the power generated acts in the longitudinal axis of the boat and is therefore used to push the boat ahead. Only a very small portion of the power (and the aerodynamic drag of the sail and rigging) act laterally to the boat and pushes the boat sideways (to the lee). On a tight beat, a great portion of the total power acts in the lateral direction, i.e., is trying to push the boat sideways.

b. The shape of the hull and its attached keel present relatively little resistance in the longitudinal direction, which makes it easy to push the boat forward through the water. Conversely, the flat side of the keel (and sometimes the form of the hull itself) present a great deal of resistance to movement in a sideways direction. This resistance of the keel to be pushed sideways, combined with the relatively narrow beam of the buoyancy chamber (the hull) result in the boat heeling to the lee.

c. The heeling of the boat instantly triggers three separate ameliorating (correcting) forces. The larger the heeling angle (up to 100 degrees) the larger will be each of the counteracting forces below:

1. Reduction of sail area. The sail, being no longer at a right angle in the wind, (vertical) generates less power. This instantly reduces the heeling force, particularly when the boat is on a beat. A sail which is pushed completely horizontal will extract no more force from the wind.
2. Displacement of the CB and CG location. The CB, being above the CG moves to leeward, while at the same time the CG, controlled largely by the keel, moves to the windward side. Thereby creating a lever arm through which the weight of the keel counteracts the pressure on the sail.
3. Reduction of keel area (at high heel angles). The keel at the bottom of the boat, being no longer perpendicular to the heeling force, provides a smaller area and therefore less resistance to the sideways movement. The boat may slip sideways and thus again reducing the apparent wind.

This continuing balancing of forces is an inherent part of the design and happens without any input from the crew. A monohull sailing boat is to a large extent self-tending. Due to the fact that the CG is lower than the CB, a monohull sailing boat will right itself even when turned to 180 degrees (assuming it stays afloat). A monohull's ultimate stability is right-side-up when afloat.

In contrast to a monohull, a catamaran generally has no ballast, as it derives its stability from two, relatively widely spaced hulls connected by crossbeams. Being much lighter than a monohull, (no ballast), a catamaran rides much higher in the water and is therefore much more affected by air currents than ocean currents. Sailing catamarans also need some means of preventing leeway. Typically this has been achieved in one of three ways:

1. Deep-V hulls, or modified deep-V hulls, whose sides act as near-vertical plates and thus present resistance to leeward movement (FIG. 1*a* and 1*b*).
2. Rounded hulls with a low aspect ratio keel (leeway preventer) at the bottom of each hull. Resistance to sideways movement is provided by the permanently extended, low aspect ratio keels (FIG. 1*c*).

3. Rounded hulls with a retractable dagger board in each hull. The hulls themselves provide only a negligible amount of resistance to any sideways movement. The dagger boards, when lowered are the means of resisting sideways movements. The dagger boards can alternately be raised and lowered as required (FIG. 1*d*).

The common feature of all sailing-catamarans is that the CG is above the CB, in some cases substantially above. Stability characteristics are therefore quite different from a monohull sailboat. The most significant difference is that the ultimate stability of a catamaran is upside-down, since in this position the CG is below the CB.

In contrast to a monohull sailing boat, initial stability of a catamaran is very high and increases rapidly in the first 5 to 10 degrees of angle of heel, until a point is reached where one hull is completely free of the water. Once the hull is clear of the water, the stability starts to decline rapidly. The higher the heel angle the less the righting force. This is the exact opposite of a monohull boat. A poorly designed catamaran may be heading for its state of ultimate stability at as little as 45–50 degrees of heel. At this angle, the CG may be already very close to the CB and wind force on the underside of the bridge-deck is on the increase.

The wind is producing the same forces on the sail as it does on the monohull boat. In light winds, both hulls are submerged equally deep, the CB is located halfway between the hulls, as is the CG. The CLR is also in the center between the hulls, since each hull is providing an equal amount of resistance to any sideward movement.

As the wind strength increases, the windward hull will start to lift as a result of the heeling force generated by the sail. The CB starts to shift toward the leeward hull. The righting moment increases, as the CB shifts toward the leeward hull and a portion of the windward hull, which was submerged (supported by the water) is now being lifted out and becomes a powerful righting force on a lengthening righting arm. As more of the windward hull is lifted clear of the water, the CB is further shifted toward the leeward hull, the righting arm increases and the full weight of the windward hull contributes toward pulling the boat back into the upright position. During the first degrees of heel the catamaran produces powerful righting forces which result in the catamaran sailing nearly upright, even in fairly strong winds.

Due to the slight angle of heel however, no wind is spilled from the sail, in spite of large wind forces, (wind pressure is not reduced like it is in the monohull boat) and the leeway preventing plates are not losing much of their effectiveness, as they remain nearly upright. If anything, the leeward plate becomes further immersed (at least in the case of deep-V hulls) and thereby becomes the major resistance to any leewards movement of the boat. The CB and the CLR are very close to each other forming a perfect fulcrum around which the whole boat can rotate, around its longitudinal axis. Once a catamaran has reached the point where the windward hull is completely out of the water, (no more weight can be added to the arm) the righting moment decreases rapidly, as the length of the righting arm decreases.

As the windward hull rises, two factors start to have an increasingly detrimental effect on the stability of the boat with the very likely result that the boat, left to its own, will capsize:

The arm through which the CG acts, becomes shorter, as the CG is moving towards the leeward hull.

The windward hull and the bridge-deck of the boat are being raised into the wind, allowing the wind to get under the boat and thus create more heeling forces.

Unless rapid counter measures are taken by the crew, the boat will likely capsize. First, the helmsman must quickly steer the boat downwind. This is contrary to the tactics of monohull sailing but crucial to preventing capsize in a multihull. If the helmsman would steer into the wind, as on a monohull, the centrifugal force generated in the rig, caused by the turn (generally larger in a multihull, due to higher speed), would be added to the heeling force and might be sufficient to capsize the boat. Steering the boat downwind instantly converts some of the heeling force into a driving force, thereby reducing the heeling force. Converting wind power into speed, by turning downwind, also shifts the apparent wind forward and thus further reduces the heeling component of the total wind power vector.

Second, if wind strength remains too high, sails should be eased to reduce the heeling force. Currently, the only hull shape which provides some additional safety is the rounded hull with retractable dagger boards. If the dagger boards are alternately raised and lowered on every tack, so that always only the board in the windward hull is down, then the boat may have a chance to slip to the side once the windward hull has lifted substantially clear of the water. Most dagger boards are of very high aspect ratio, however, which means that the hull would have to rise 4 or 5 feet before any appreciable side slipping can take place. The only effective defense would be to lower the windward dagger board only partially in heavy weather to permit the boat to slip sideways as soon as the windward hull starts to lift free of the water (see FIG. 1*d*). Dagger boards are not favored by builders and customers of cruising catamarans because they, also, have a number of drawbacks:

The dagger board boxes take up much room inside the hulls.

Dagger boards are easily broken when hitting floating objects.

The dagger board may rip a hole on accidental ground contact or when hitting floating objects.

Cumbersome often expensive gear is required to raise and lower the boards.

To operate the boards is a substantial chore for a shorthanded crew.

This leaves catamaran sailors with three options:

1. Use only undersize rigs on catamarans so that the will never generate sufficient force to lift a hull. This means a substantial loss of possible speed when conditions are not dangerous.
2. Set the hulls so far apart that even a tall rig will not b able to lift a hull. This option has technical as well as practical limitations.
3. Be on constant alert and take evasive action in case of wind strength or direction change or in case of large waves approaching (the latter may be difficult to see at night).

DESCRIPTION OF A PREFERRED EMBODIMENT

The drawings in the present invention are essentially schematic drawings for the purpose of illustrating the concept of the invention. The drawings are not drawn to any specific scale, nor do they represent in any way a limit to the application of the concept of the invention.

The present invention is in no way limited to any specific hull type, nor does it matter what kind of superstructure is built on the deck of the catamaran or what shape the hulls assume above the water line.

FIGS. 1*a–d* depict four of the currently most common hull types or categories, used for sailing catamarans. It must be remembered that there are an infinite number of variations. The arrows (R), are to visualize the resistance to sideways movement in each of the different designs as well as the general location of this resistance. The number of arrows illustrate the magnitude of this resistance.

Figure 1A:
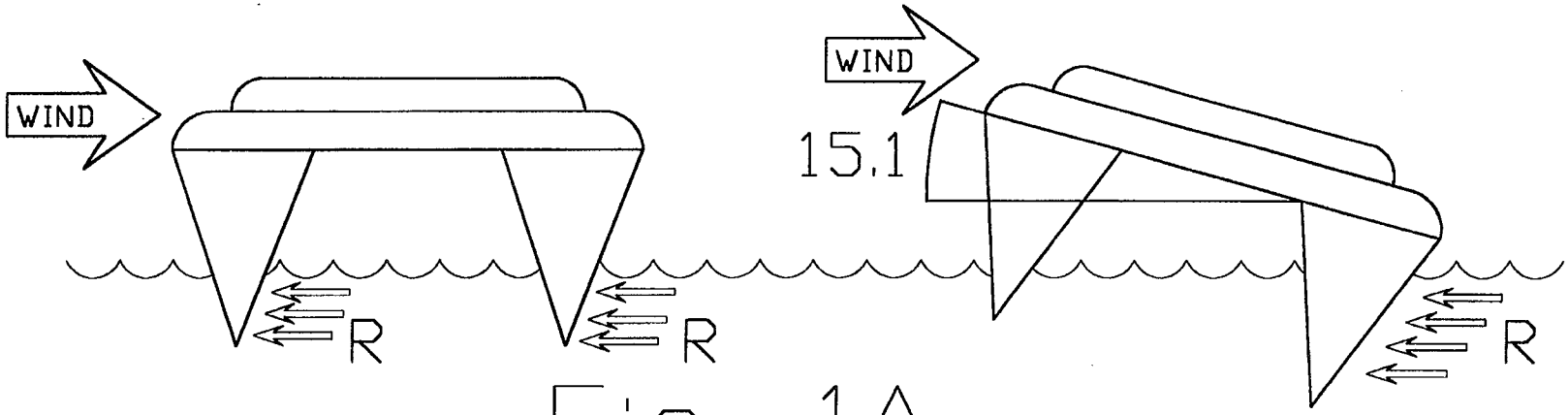
FIGS. 1*a–d* depict four of the currently most common hull shapes used for cruising catamarans.

FIG. 1*a* illustrates deep V-shaped hulls which are easy to construct, very high wetted surface area (slow), difficult to maneuver, very sensitive to overloading (loss of maneuverability).

Figure 1B:
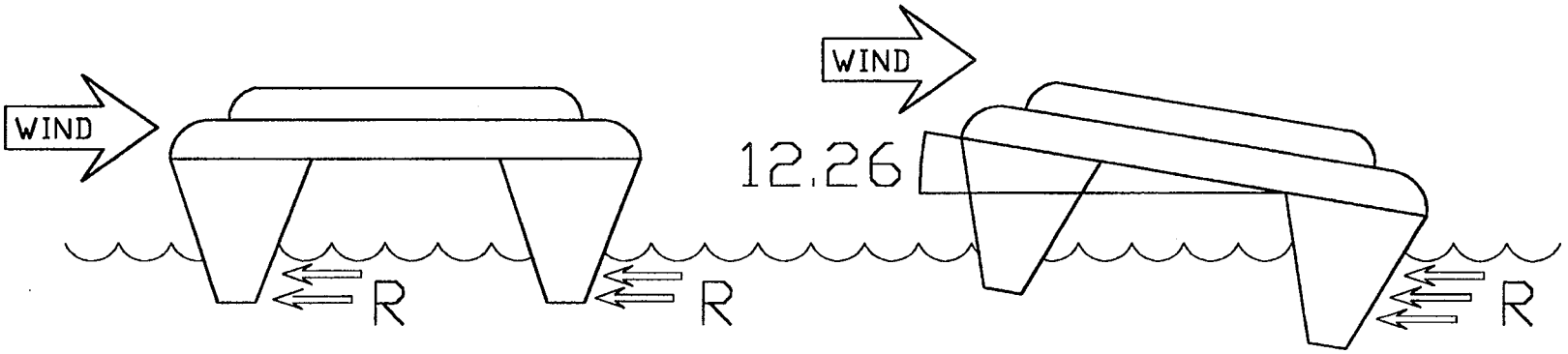
Figure 1C:
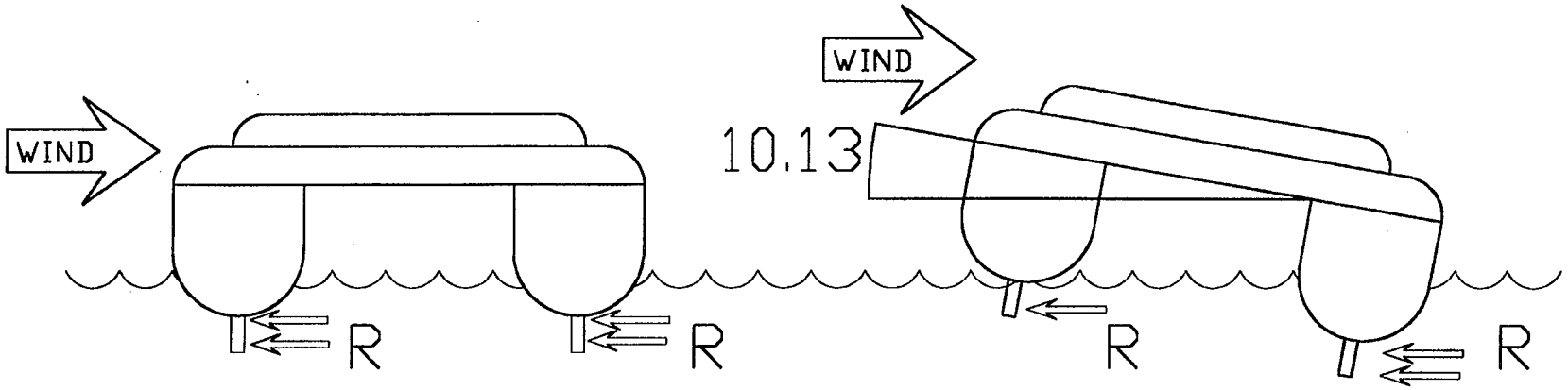
Figure 1D:
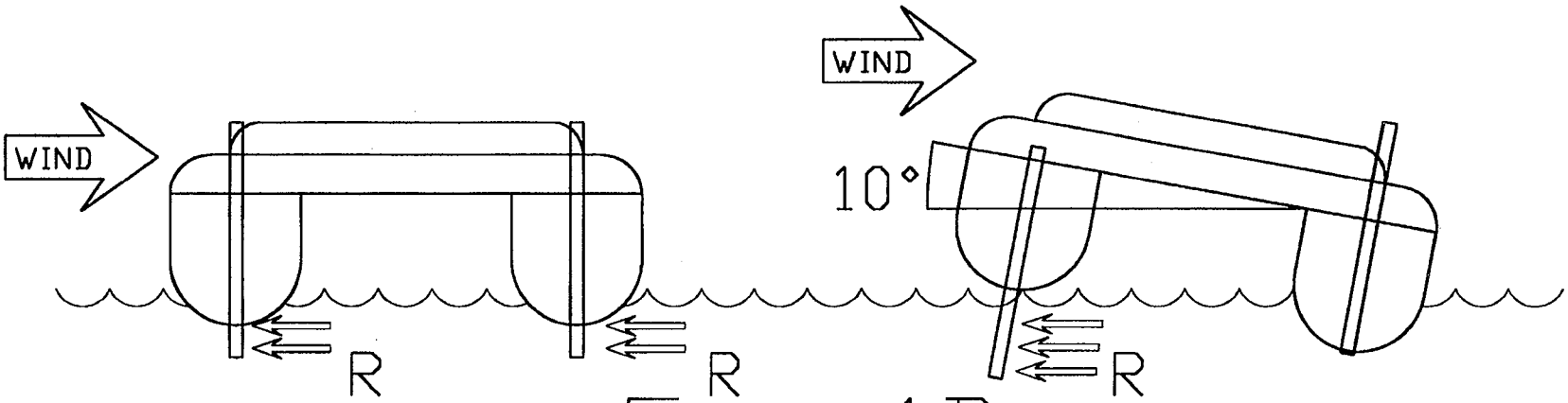

FIG. 1*b* illustrates modified V-shaped hulls. A hull design where the keel is not formed by a simple connection of the two sides of the hull, but where the two sides are joined to a flat bottom piece. Higher load carrying capability, shallow draft, but reduced leeway-resistance. Sometimes low aspect ratio keels are fitted, similar to the rounded hulls in FIG. 1*c*.

FIG. 1*c* depicts rounded hulls with low aspect ratio, fixed keels. Minimum wetted hull-area (fast; although the fixed keels add wetted area on all points of sail, negating some of the advantage), high load carrying ability.

FIG. 1*d* depicts a rounded hull with retractable dagger boards. Minimum wetted area for highest speed. High aspect ratio dagger boards for very efficient leeway prevention. Dagger boards are deployed only as much as necessary for any given circumstance, that is, they can be fully lowered to achieve maximum windward performance or they can be fully retracted, for minimum wetted surface, on a run. They represent possibly the safest configuration in the hands of an experienced crew (leeway resistance always in the windward hull, or completely eliminated in survival conditions). But dagger boards are costlier, sensitive to damage, require more work, interfere with interior space.

Figure 2D:
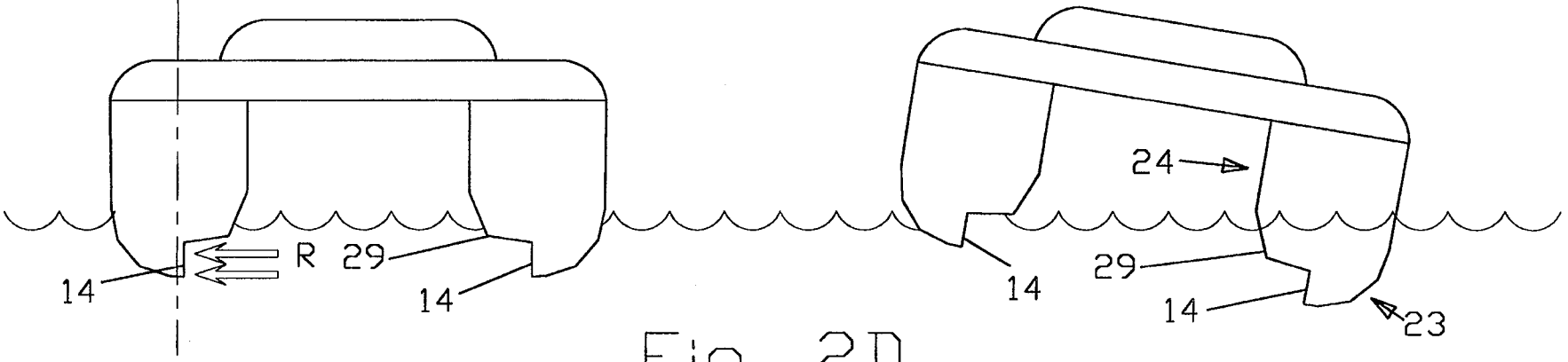

FIG. 2 depicts some variations of the practical application of the present invention. The salient feature in each of the examples is the rounded outboard side of each hull, which extends right down to the lowest portion of the keel. The inboard sides of each of the hulls show the types of hull used in the example in FIG. 1 to illustrate the variety of shapes possible. The important difference, between the hull examples in FIG. 1 and FIG. 2, is in the location of the surfaces providing lateral resistance, as depicted by the arrows. Leeway prevention is achieved in all cases by the windward hull only, while the leeward hull presents only negligible resistance to sideways motion. It can be easily seen that heeling beyond 10 or 12 degrees would lift the windward hull clear of the water and thereby eliminate all leeway resistance, allowing the hull to slide sideways. The dashed line 11, extending through all four hulls at the left side of the schematic drawing in FIGS. 2*a–d*, is to indicate the position of the bow and the center of the stern in each of these hulls.

FIG. 2*a* depicts a rounded outboard hull combined with a V-type inboard hull section. In this schematic, the leeway preventing surface is slightly angled (as it would be in a deep-V hull depicted in FIG. 1) and the top portion of the surface is curved.

FIG. 2*b* depicts a rounded outboard hull combined with a modified V-type inboard hull section. In this combination the leeway preventing surface is also slightly angled and the whole surface is curved as it would be in a hull depicted in FIG. 1*b*.

FIG. 2*c* depicts a schematic of rounded hull sections inboard and outboard, but offset with each other to create a leeway preventing plate area on the windward hull. In this applications, the leeway preventing surface is flat and generally perpendicular when the boat is not heeled. The location of the surface could be coinciding with the bow, more or less, but the bow line would not have to be at the center of the hull (as shown in FIG. 2), indicating that the inboard and the outboard side of the hull are of different width.

FIG. 2*d* depicts the present invention applied to a multi-chined catamaran hulls. The effect is comparable to the hull section in FIG. 2*c*, (achieving the same effect) but the hulls can be built with flat materials, such as plywood or metal.

Figure 3:
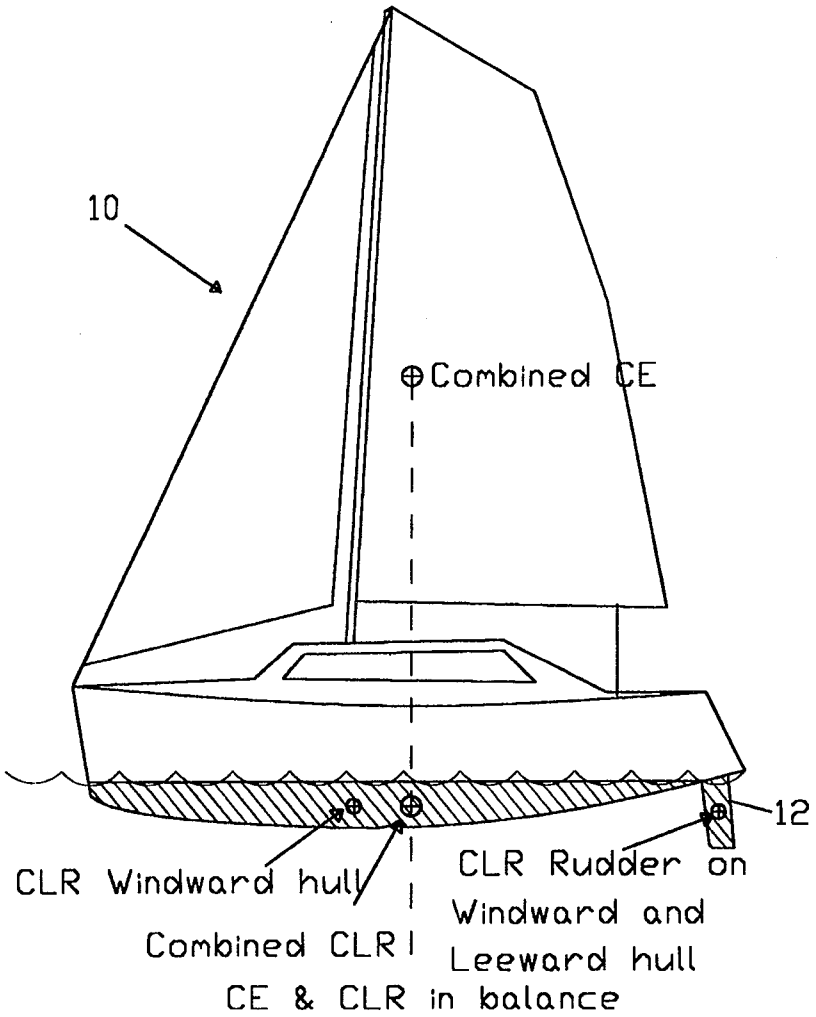
FIG. 3 depicts a catamaran of the present invention in a normal sailing configuration.

FIG. 3 illustrates a catamaran using the present invention in a normal sailing configuration. The shaded part of the hull shows the total area of lateral resistance, and the position of the CLR, when the boat is sailing under normal conditions. Note that the CE of the sail is in balance with the CLR, that is the boat, with its rudder 12 centered, will maintain a straight course.

Figure 4:
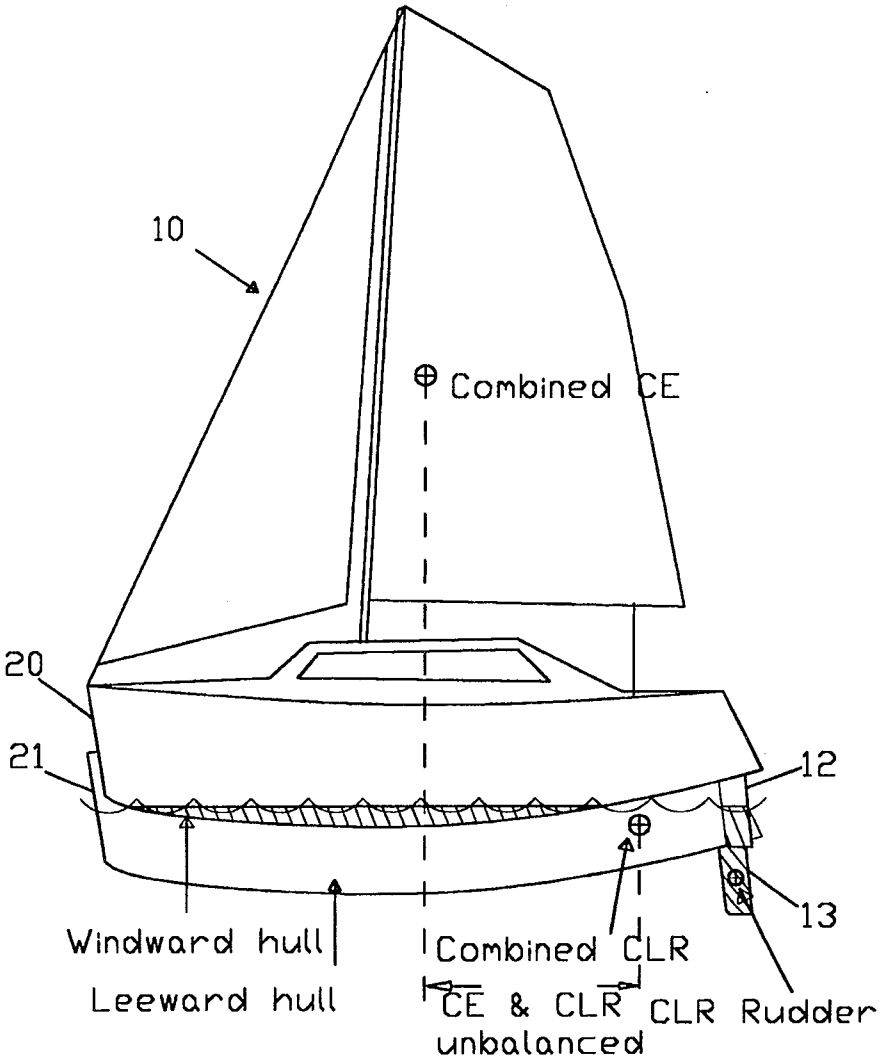
FIG. 4 depicts a catamaran of the present invention on the verge of lifting the windward hull free of the water.

FIG. 4 illustrates a catamaran using the present invention, on the verge of lifting the windward hull free of the water. Much of the leeway preventing surface 14 is already clear of the water (thereby ineffective). The rudders 12 and 13, particularly the leeward rudder 13, maintain their full effectiveness while the lateral resistance of the windward hull rapidly diminishes. Total lateral resistance is greatly reduced and the CLR of the remaining resistance has shifted towards the stern of the boat. CE and CLR are out of balance. With the rudder kept straight, the bows of the boat, and therefore the whole boat, will turn downwind. This is exactly the action the helmsman of a multihull should take when the boat is on the verge of being overpowered by the wind, only in this case it is happening automatically, an action induced by the design of the hull.

Figure 7:
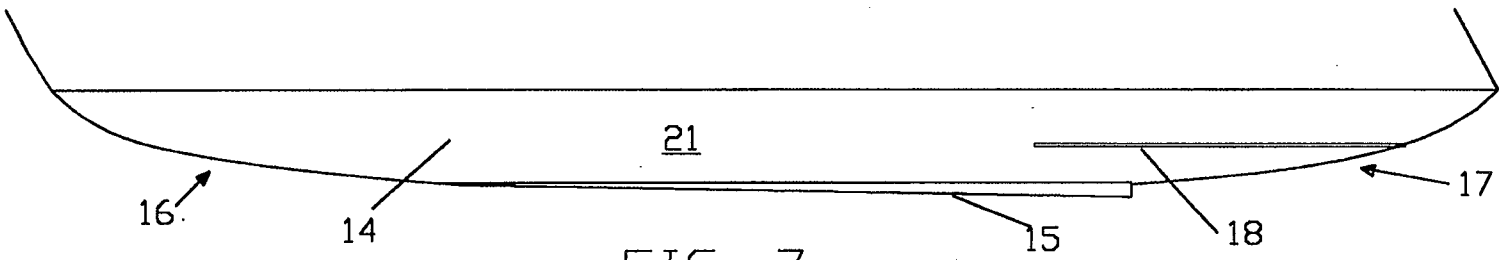
FIG. 7 is a view of a starboard hull from the center of the boat.
Figure 6:
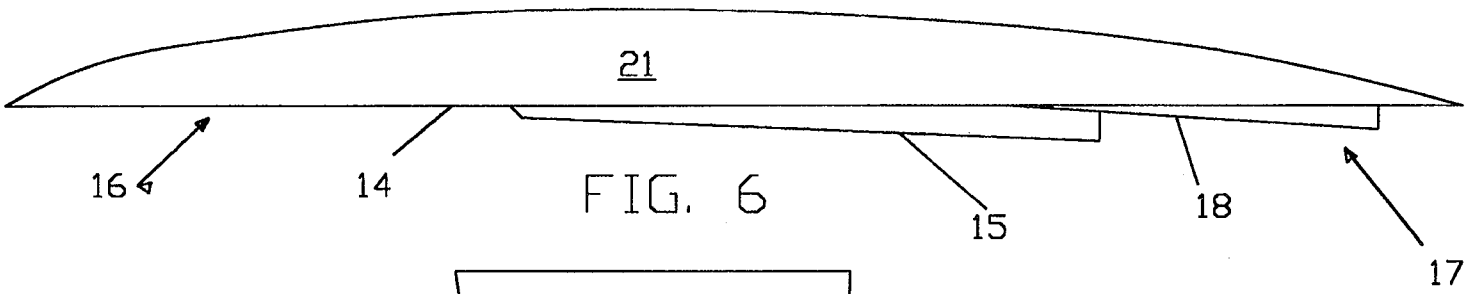
FIG. 6 is a top view of a keel section with endplate and fence installed.
Figure 5:
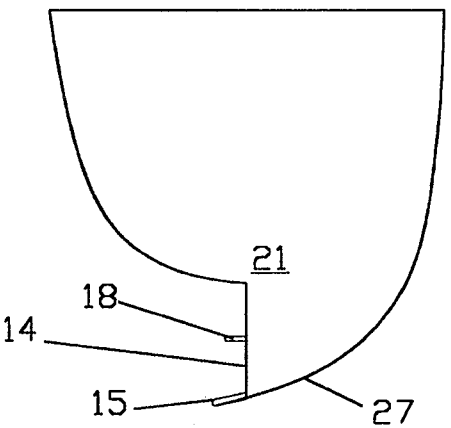
FIG. 5 is a stern view showing the position of endplate and flowfence installed.

The schematic in FIGS. 5 through 7 depict an alternative embodiment of the present invention. To make the leeway resisting surface 14 more effective, it is recommended that a small winglet, or tapered rail 15 (endplate), be fitted at the bottom edge of the surface 14. The rail 15 will counteract the formation of a vortex around the lower edge of the leeway preventing surface 14. It is intended that the rail 15 begins close to the forward end 16 of the surface 14 and ends at the aft end 17 of the surface 14. The rail 15 may be tapered appendage, starting as a narrow ledge at the forward end 16 and protruding as much as 20% of the height of the surface 14, at the aft end 17 of the surface 14. This rail 15, or highly elongated delta-winglet, may protrude at an angle of 90 degrees to 120 degrees of the vertical, from the surface 14. The rail 15 should only be fitted to the portion of the lower edge which runs parallel, or near parallel to the water line. For hull shapes with more rocker, where the portion of the keel which runs parallel to the water line is short, installation of additional fences at the aft end of the plate are recommended. A second winglet, or rail 18 is affixed near the aft end 17 of the surface 14 directly above the rail 15. The winglets, or rails 15 and 18 help to keep the waterflow parallel rather than turning the waterflow into a lift destroying vortex.

It should be understood that the foregoing relates only to a disclosed embodiment of the present invention, and that numerous changes or modifications may be made therein without departing from the spirit or the scope of the invention as defined in the following claims.

What is claimed is:

1. A set of sailing catamaran keels having twin hulls, said keels comprising a port keel and a starboard keel, each of said keels having:

a rounded or shallow angled outboard keel surface which is blended into the shape of the outboard portion of a catamaran's hull for eliminating leeway resistance thereby allowing the catamaran to slip sideways when it is in danger of being overpowered by the heeling force of the wind, a vertical or steeply angled inboard keel surface facing towards the center line of the catamaran, and meeting the catamaran hull at or near the fairbody line for forming an effective leeway preventing surface, said outboard keel surface providing a lateral, non resistance surface, and said inboard keel surface, providing a lateral, leeway resistance surface, the efficiency thereof being reduced or eliminated by the catamaran's heeling, whereby a portion of the heeling component is converted into a leeway movement.

2. A set of keels for sailing catamarans according to claim 1 wherein said inboard keel surface comprises a vertical portion extending upwardly from the bottom of said keel to a point slightly below the water line and a rounded or angled keel surface extending upwardly above said vertical portion to the hull.

3. A set of keels for sailing catamarans according to claim 2 wherein said vertical portion is fitted with a horizontal, tapered rail at the bottom of the keel, protruding towards the inboard side of each keel for resisting the formation of vortexes at the bottom of the leeway preventing surface.

4. A set of keels for sailing catamarans according to claim 3 wherein said vertical portion is fitted with a horizontal flow-directing second rail on the aft end of said vertical surface and above said tapered rail for maintaining parallel flow of water along the whole length of said rail and thereby making the vertical surface more efficient.

5. A set of sailing catamaran hulls having a deck structure connecting two asymmetrical hulls, and having at least one rudder, each of said hulls having an inner and an outer surface extending downwardly from the deck structure to a keel, said keel comprising:

a rounded or shallow angled outboard keel surface which is blended into the shape of the outboard surface of a catamaran's hull for eliminating leeway resistance and thereby allowing the catamaran to slip sideways when it is in danger of being overpowered by the heeling force of the wind, a vertical or steeply angled inboard keel surface facing towards the center line of the catamaran, and meeting the catamaran at or near the fairbody line for forming an effective leeway preventing surface, and said rudder representing a small portion of the total lateral resistance, for delaying the sideways motion of the stern and thereby automatically steering said catamaran downwind in critical conditions, said outboard keel surface providing a lateral, non resistance surface, and said inboard keel surface providing a lateral, leeway resistance surface, the efficacy thereof being reduced or eliminated by the catamaran's heeling, whereby a portion of the heeling component is converted into a leeway movement.

6. A catamaran according to claim 5 wherein said inboard keel surface is fitted with a horizontal, tapered rail at the bottom of the keel, protruding towards the inboard side of each keel for resisting the formation of vortexes at the bottom of the leeway preventing surface.

7. A catamaran according to claim 6 wherein said inboard keel surface is fitted with a horizontal flow-directing second rail on the aft end of said vertical surface and above said tapered rail for maintaining parallel flow of water along the whole length of said rail and thereby making the vertical surface more efficient.

8. A catamaran having a deck structure connecting two asymmetrical hulls, and having at least one rudder, each of said hulls having an inner and an outer surface extending downwardly from the deck structure to a keel, said keel comprising:

a rounded or shallow angled outboard keel surface which is blended into the shape of the outboard surface of a catamaran's hull for eliminating leeway resistance, a vertical or steeply angled inboard keel surface facing towards the center line of the catamaran, and meeting the catamaran at or near the fairbody line for forming an effective leeway preventing surface, a horizontal, tapered first rail secured to the bottom of the keel, protruding towards the inboard side of each keel for resisting the formation of vortexes at the bottom of said inboard keel surface, and a second, horizontal flow-directing rail on the aft end of said vertical surface and above said tapered rail for maintaining parallel flow of water along the whole length of said rail and thereby making the vertical surface more efficient.

* * * * *